United States Patent [19]

Rapp et al.

[11] 4,184,816

[45] Jan. 22, 1980

[54] ANGLED-EDGE CONTROLLED FUEL INJECTION PUMP FOR INTERNAL COMBUSTION ENGINES

[75] Inventors: Karl Rapp, Stuttgart; Hans Brett, Bietigheim; Alex Tyrolt, Denkendorf; Gabriel Stabentheiner, Stuttgart, all of Fed. Rep. of Germany

[73] Assignee: Robert Bosch GmbH, Stuttgart, Fed. Rep. of Germany

[21] Appl. No.: 901,660

[22] Filed: May 1, 1978

[30] Foreign Application Priority Data

May 5, 1977 [DE] Fed. Rep. of Germany ..... 2720279

[51] Int. Cl.[2] ..... F04B 7/04; F02M 59/26

[52] U.S. Cl. ..... 417/499; 123/139 AA; 123/139 AD

[58] Field of Search ..... 417/490, 494, 499; 92/86.5, 87; 123/139 AA, 139 AR, 139 AD, 139 AE, 139 R

[56] References Cited

U.S. PATENT DOCUMENTS 2,420,164 5/1947 Bremser ..... 417/494

3,857,653 12/1974 Mowbray ..... 417/494

FOREIGN PATENT DOCUMENTS 1068783 6/1954 France ..... 417/494

*Primary Examiner*—Leonard E. Smith

*Attorney, Agent, or Firm*—Edwin E. Greigg

[57] ABSTRACT

An edge controlled fuel injection pump for internal combustion engines, whose axially and rotationally movable pump piston, guided within the pump cylinder, has an improved leakage oil return system, which avoids piston wear and increased oil leakage even under very high injection pressures and relatively short piston strokes. The pump piston has an annular leakage oil collecting groove next to, but separate from, the recess that serves to end the fuel delivery, and a plurality of narrow leakage oil return grooves, which are formed in the outer surface of the piston diametrically opposite the recess and are connected with the collecting groove. Of these leakage oil return grooves, at least one is always connected with a leakage oil bore in the pump cylinder to a chamber of low pressure in the pump during the useful stroke of the piston.

16 Claims, 10 Drawing Figures

ANGLED-EDGE CONTROLLED FUEL INJECTION PUMP FOR INTERNAL COMBUSTION ENGINES

BACKGROUND OF THE INVENTION

The invention relates to a fuel injection pump with at least one pump piston that is controlled by edges on the piston and cylinder wall and which is driven with a constant stroke and is both axially and rotationally movable within a pump cylinder. The piston has a edge control recess in its outer surface, which is in constant communication with the operating chamber of the pump and which during the stroke of the piston connects the operating chamber with a chamber with a lower pressure-preferably the suction chamber of the pump-through a control bore in the wall of the pump cylinder to end the fuel delivery. The pump piston has an annular leakage oil collecting groove, that is separated from this edge control recess and which can be connected with the low pressure chamber through a leakage oil bore in the wall of the pump cylinder opposite the control bore, by means of leakage oil channel means formed in the outer surface of the piston diametrically opposite the recess, and extends in the direction of the operating chamber end of the pump piston.

A similar fuel injection pump is already known (FR-PS No. 1068783), whose pump piston has a leakage oil collecting groove machined into the outer surface of the piston and arranged separate from the edge control recess which determines the end of fuel delivery. Connected to this leakage oil collecting groove is a leakage oil channel that extends toward the operating chamber end of the pump piston and is formed as a flat area. The width and length of this leakage oil channel are such that at least during the effective useful stroke of the pump piston, there is a connection from the leakage oil collecting groove to the suction chamber of the pump by means of this channel and a leakage oil bore in the pump cylinder. This leakage oil channel being relatively wide, reduces the supportive portion of that part of the outer surface of the pump piston opposite the edge control recess to such a degree, that under very high injection pressures, the lubricating film, formed by the fuel between the surface of the pump piston and the wall of the cylinder bore of the remaining surface of the pump piston, is expelled. The increased surface pressure and simultaneous worsening of the lubrication causes an increased wearing of the pump piston. In addition, the very high injection pressures tend to bend the pump piston, which has been weakened on one side by the recess, whereby the above described wear of the pump piston is increased even more.

In a second embodiment of the above referred to known fuel injection pump, the leakage oil collecting groove and the leakage oil channel are formed by a single annular groove arranged across the piston to cooperate with the leakage oil bore in the wall of the pump cylinder during the useful stroke of the pump piston. As such, the single groove must be wide enough that the leakage oil return is effective in the desired useful stroke range of the pump piston. This wide cross groove leads to the same disadvantages as the above described flat area on the pump piston that serves as the leakage oil channel.

SUMMARY OF THE INVENTION

The fuel injection pump according to the invention includes at least one pump piston driven at a constant stroke movable both axially and rotationally within a pump cylinder, said piston having an edge control recess in continual communication with the operating chamber of the pump and opening into a low pressure chamber through a control bore during the piston stroke to end fuel delivery. The pump piston further has an annular oil leakage collecting groove separated a distance from the recess but which can be in communication with said low pressure chamber by means of an oil leakage channel means and a leakage oil bore in the pump cylinder wall opposite the control bore. In the embodiments disclosed, the oil leakage channel means comprises a plurality of oil leakage return grooves with at least one groove always in communication with said leakage oil bore. This has the advantage in that the outer surface of the piston, which is heavily loaded under very high injection pressures is only slightly weakened, and an increased surface pressure is avoided particularly in the area of the return groove edges. One further advantage is the improved rigidity against bending, and the narrow leakage oil grooves accommodate the lubrication in the heavily loaded area on the pump piston so that excessive piston wear is avoided.

As will be clear from the following description of the leakage oil channel means, additional advantages can be achieved. For example, the leakage oil return grooves can be simply and inexpensively produced by stamping the outer surface of the piston and this arrangement of at least two leakage oil return grooves, which emanate from the leakage oil collecting groove and formed as cross or longitudinal grooves, is easy to produce and satisfies average demands. At very high injection pressures (above 500 to 600 bar), it has been shown to be advantageous to have at least two preferably parallel cross grooves and at least one connecting groove connecting the cross grooves with each other and to the leakage oil collecting groove to serve as leakage oil return grooves. An arrangement that is both favorable for rigidity and for the lubrication is to have the connecting groove formed longitudinally of the piston and the cross grooves, preferrably equally long, arranged on one side and opening into this longitudinal groove. An oil scraping effect is obtained by the narrow cross grooves, by means of which the lubrication is improved. Further, when the longitudinal groove comes out of contact with the leakage oil bore during the useful stroke (and in the rotational range of the pump piston that determines the fuel injection quantity between idling and full load), then this lubricating effect is improved still more. By making the groove cross section as small as possible yet sufficient to return a quantity of leakage fuel equal to the incoming leakage fuel quantity and by correspondingly positioning the grooves to achieve the foregoing advantages also makes it possible to shorten the pump piston and the associated pump guiding, which results in a desirable low pump structural height.

Further advantages that can be obtained will be apparent to those skilled in the art after a reading of the following description wherein four exemplary embodiments are described with reference to the drawings.

DESCRIPTION OF THE PREFERRED EMBODIMENTS

The first embodiment to be described in connection with FIGS. 1 through 4 is shown in an edge controlled one cylinder fuel injection pump, but of course the invention includes multiple cylinder fuel injection pumps, often designated as series injection pumps, as well.

Figure 1:
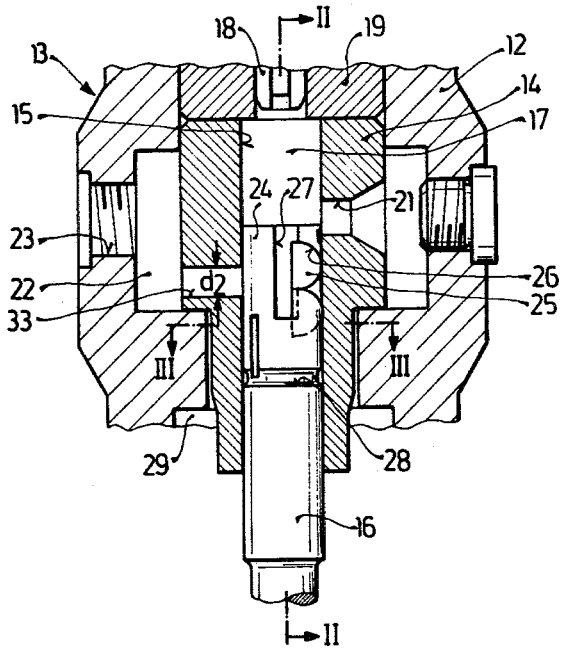
FIG. 1 is a longitudinal sectional view of a portion of the injection pump embodying the first embodiment of the invention.
Figure 2:
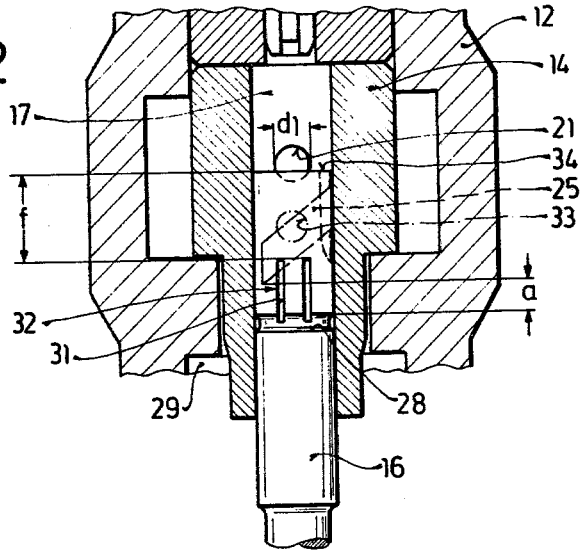
FIG. 2 is a sectional view along the line II—II in FIG. 1.

In FIG. 1 a pump cylinder 14 is located in a housing 12 of an injection pump 13 both of which are only partially shown. This pump cylinder 14 has a cylindrical bore 15 which guides a pump piston 16 that is both axially and rotationally movable. An operating chamber 17 is formed in a portion of the cylindrical bore 15 on one side by the pump piston 16 and on the other side, ie, on the delivery side of the pump by a pressure valve housing 19, which contains a pressure valve 18. The pressure valve 18 and the pressure valve housing 19 are both of a known construction and are only partially shown. The operating chamber 17 of the pump is connected with a chamber having a lower pressure, designated as a suction chamber 22, by means of a control bore 21, which serves both as a suction and return flow bore. The fuel, which is placed under the delivery pressure of a preliminary delivery pump, flows into this suction chamber 22 through a fuel feed conduit, which is connected to a delivery bore 23, but is not shown in detail.

A recess 25 is formed in a known manner as by machining as an angular groove in the outer surface 24 of the pump piston 16. The end of this angular recess 25 that points toward the operating chamber 17 of the pump, together with the outer surface 24 of the pump piston 16, forms a control edge 26. This edge control recess 25 is in continual communication with the operating chamber 17 of the pump by means of a longitudinal groove 27, which is machined into, or otherwise formed in, the pump piston.

Of course, in lieu of the longitudinal stop groove 27, a longitudinal bore within the pump piston 16 can connect the operating chamber 17 of the pump with the recess 25, and in lieu of the recess 25 that forms the control edge 26, the control edge can also be milled or ground into the outer surface in the form of a helix.

In order to capture the fuel that leaks through the passage between the pump piston 16 and the cylinder bore 15, which passage is sealed for high pressures but leakage occurs despite the play between said two elements being only a few thousandths of a millimeter, the outer surface 24 of the pump piston 16 has an additional leakage oil collecting groove 28, which runs annularly around the entire circumference of the pump piston 16. This leakage oil collecting groove 28 is spaced a distance from the deepest point of the recess 25 sufficient to maintain high pressure seal between both the operating chamber 17 of the pump and to the recess 25 (see in this regard FIGS. 2 and 4). The fuel, collected or captured in this leakage oil collecting groove 28, is prevented from flowing further downward into the spring and drive works chamber, indicated as 29 and not described in any greater detail, where it would have thinned the lubricating oil in an unacceptable manner. This type of thinning is especially critical when the drive works chamber 29 of the injection pump 13 is connected to the lubricating oil circulating system of the internal combustion engine. The fuel captured in the leakage oil collecting groove 28 is bled off through a leakage oil channel indicated as 32 and formed by two leakage oil lead-off grooves 31 and through a leakage oil bore 33 in the wall of the pump cylinder 14 to the suction chamber 22. The two leakage oil lead-off grooves 31 are machined into the outer surface 24 of the piston diametrically opposite the recess 25. The leakage oil collecting groove 28 is in constant communication with these two grooves 31, which in the first exemplary embodiment shown in the FIGS. 1 through 4, are formed as two longitudinal grooves that are arranged parallel to each other and parallel to the longitudinal axis of the pump piston 16. These two grooves 31, because of their small width and depth, may advantageously, be stamped into the outer surface 24 of the pump piston 16 instead of being machined as aforesaid.

The cross section of the leakage oil return grooves 31, although very narrow in comparison to the recess 25, provide optimum performance if they are barely sufficient to return the leaking fuel quantity to the leakage oil bore 33. The diameter and the position of the leakage oil bore 33, the width B (see FIG. 4) of the leakage oil return grooves 31, the distance b of these grooves 31 to each other and their position on the outer surface 24 of the piston as well as their length are very important for a smooth functioning of the leakage oil return. Thus, the leakage oil bore 33 opens into the cylinder bore 15 but with a certain axial distance c from the control bore 21, and the leakage oil return grooves 31 are positioned on the outer surface 24 of the piston and at a distance b from each other such that at least one of the leakage oil return grooves 31 is in communication with the leakage oil bore 33 during the useful stroke and within the rotational range e of the pump piston 16 that determines the quantity of fuel injected between idling and full load. Most of the operations of the injection pump are within this range, and this is also where the highest pressures occur, which, in turn cause a corresponding amount of oil leakage. The width B of the leakage oil return grooves 31 should be no more than 0.4 times the diameter $d_1$ (FIG. 2) of the control bore 21. In this arrangement of the leakage oil return grooves, it should also be noted that the extreme end of the leakage oil return grooves 31, which are toward the operating chamber 17 of the pump and are away from the leakage oil collecting groove 28, has at least a spacing distance f from the frontal surface 34 of the pump piston 16 to assure a high pressure seal to the operating chamber 17 of the pump (see FIG. 2). The side separations of the leakage oil return grooves 31 to the recess 25 and to the longitudinal stop groove 27 must also be selected in such a manner that a minimum spacing is provided that will assure a high pressure seal (see distances g and h in FIG. 4). As can be seen in the cross section in FIG. 3, the distance b between the leakage oil return grooves 31 is smaller than the diameter $d_2$ of the leakage oil bore 33, which like the control bore 21, is shown in this sectional illustration with broken lines.

Figure 5:
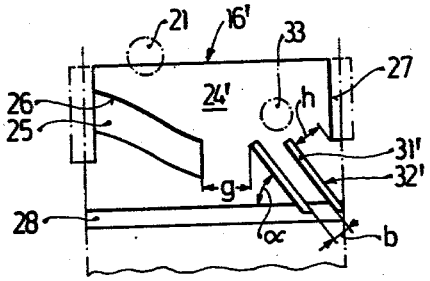
FIG. 5 is a development like FIG. 4, however, showing the second embodiment of the invention.

The second exemplary embodiment differs from the first exemplary embodiment shown in the FIGS. 1 through 4, only by a different arrangement of the leakage oil return grooves. Therefore in FIG. 5 all that is shown is a development of the outer surface 24' of the pump piston 16'. Differing from the pump piston 16 of FIG. 4, two leakage oil return grooves 31' are machined into or otherwise formed in the outer surface 24' of the pump piston 16'.

These leakage oil return grooves 31' are formed as angled or spiral grooves and serve as the leakage oil channel 32'. The inclination angle $\alpha$ of these leakage oil return grooves 31' runs in the same direction as the control edge 26 i.e. the recess 25. The distance b of the grooves 31' from each other and their distances g and h from the recess 25 and to the stop groove 27 are shown as in FIG. 4, because they are subject to the same arrangement criteria with regard to the high pressure seal and leakage oil return as the grooves 31 according to FIG. 4. The inclined position of the leakage oil return grooves 31', in contrast to the axial position of the grooves 31 of the first exemplary embodiment, has the advantage in that during the stroke of the pump piston 16' an oil scraping effect takes place at the edges of the leakage oil return grooves 31', which leads to an improved lubrication of the highly loaded edges and of the outer surface of the pump piston 16' bordering the grooves.

Figure 6:
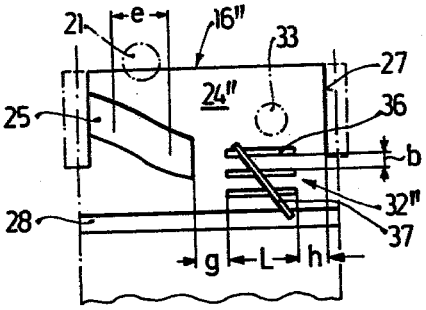
FIG. 6 is a development like FIG. 4, however, showing the third embodiment of the invention.
Figure 7:
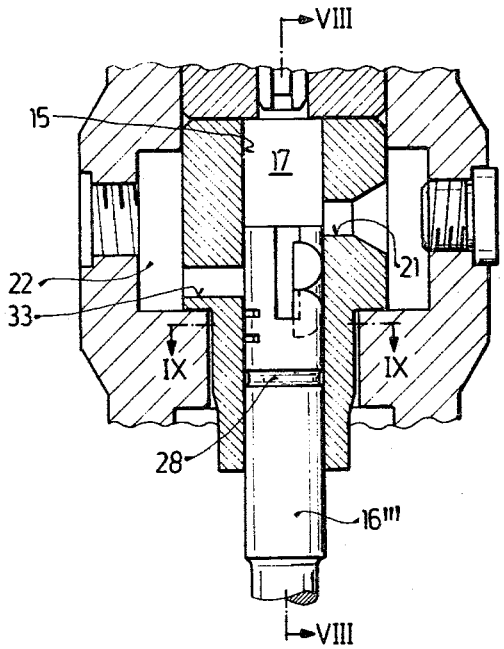
FIG. 7 is a longitudinal sectional view of a portion of the injection pump embodying the fourth embodiment of the invention
Figure 8:
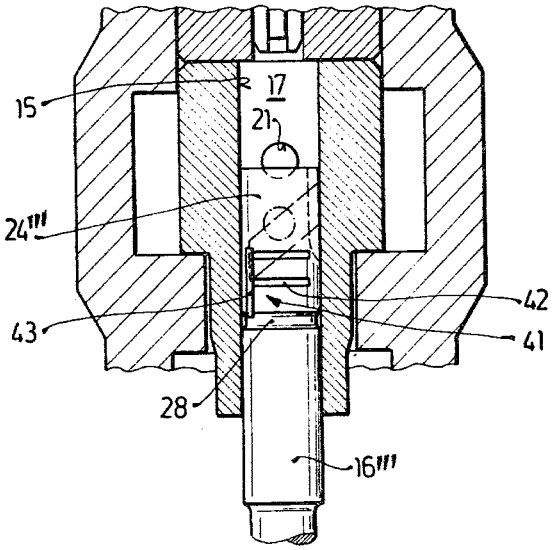
FIG. 8 is a sectional view along the line VIII—VIII in FIG. 7.

The third embodiment shown in FIG. 6 is like the second embodiment and is distinguished from the embodiment shown in the FIGS. 1 through 4, only by a different arrangement of the leakage oil channel 32'' in the pump piston 16''. In order to assure a good lubrication under high loads as well as a reliable leakage oil return, the leakage oil channel 32'' consists of three parallel cross grooves 36 that are arranged horizontally on the outer surface 24'' of the piston. These cross grooves 36 are connected with each other and with the leakage oil collecting groove 28 by means of connecting groove 37. This connecting groove 37 is formed as an angled groove, i.e., inclined to the longitudinal axis of the pump piston 16''. The horizontal cross grooves 36 give an improved lubricating effect in this area of the outer surface 24'', which lies diametrically opposite the recess 25 and is heavily loaded by the injection pressure.

The fourth embodiment is shown in the FIGS. 7 through 10, which correspond to the FIGS. 1 through 4 of the first embodiment except for the altered arrangement of the leakage oil channel. The pump piston 16''' has a leakage oil channel 41 machined or otherwise formed in its outer surface 24''' in the form of an "F" and consists of two cross grooves 42 and one longitudinal groove 43 which serves as a connecting groove. The equally long, parallel cross grooves 42, which are arranged at right angles to the longitudinal axis of the pump piston 16''', open at one end into the longitudinal groove 43, which connects the cross grooves 42 with each other and with the leakage oil collecting groove 28. The longitudinal groove 43 of this F-shaped leakage oil channel means 41 is so arranged that, during the useful stroke and in the rotational range (e in FIG. 10) of the pump piston 16''', which range e determines the fuel injection quantity between idling and full load, the longitudinal groove 43 only comes into connection with the leakage oil bore 33 by means of at least one of the cross grooves 42.

The rotational range e designates the possible position of the control bore 21 with reference to the control edge 26 of the recess 25 in the corresponding rotational position of the pump piston between its setting at idling and full load.

The longitudinal groove 43, which runs in the axial direction of the pump piston 16, as stated above, is arranged in such a manner that it does not come into direct communication with the leakage oil bore 33 in the described rotational range e of the pump piston 16'''. This has the advantage in that the fuel collected in the leakage oil collecting groove 28 always arrives in at least one of the cross grooves 42 before it is let into the suction chamber 22 through the leakage oil bore 33. In this manner, during the always constant stroke movements of the pump piston 16''', oil can be scraped out of the cross grooves 42 in order to lubricate the surrounding contact surfaces between the outer surface 24''' and the cylinder bore 15.

The length of the cross grooves 42 is shown like the cross grooves 36 in FIG. 6 by the designation L, and their smallest possible value is determined by the rotational range e of the pump piston 16' and 16''' (FIGS. 6 and 10), which determines the fuel injection quantity between idling and full load. The largest possible value of this length L, in contrast, is limited by a minimum distance g plus h from the edge control recess 25 that determines the end of delivery (i.e. from the stop groove 27 that determines the zero delivery point), which minimum distance, g plus h, is barely sufficient to assure a sufficient high pressure seal. This arrangement holds true also for the two previously described embodiments according to FIG. 6 and FIGS. 7 through 10.

In the fourth embodiment, the longitudinal groove 43 is arranged next to the end 25*a* (FIG. 10) of the edge control recess 25, which controls the largest possible fuel injection quantity. This has the advantage that when the pump piston 16''' is set for the delivery of the greatest possible fuel injection quantity, the leakage oil bore 33 passes over the area of the cross grooves 42 that is at the farthest distance from the longitudinal groove. Because of this distance the fuel that collects in the leakage oil collecting groove 28 has to pass through nearly the entire length of the cross grooves 42 in order to reach the leakage oil bore 33. This substantially improves the lubricating effect.

The width $B_1$ of the cross grooves 32 and width $B_2$ the longitudinal groove 43 are held quite small, and it has proven to be advantageous when the width $B_2$ of the longitudinal groove 43 is smaller than its depth $T_2$ (FIG. 9) and the width $B_1$ of the cross grooves 42 is larger than its depth $T_1$. The narrower cross section of the longitudinal groove 43 is advantageous because the adhesion of the oil to the wall of the cylinder of the vertical oil moving inside this longitudinal groove 43 is interfered with during the stroke movements of the pump piston 16''', and this interference is smaller in a very narrow but deeper groove than in a groove having a width and depth that are the same.

Figure 3:
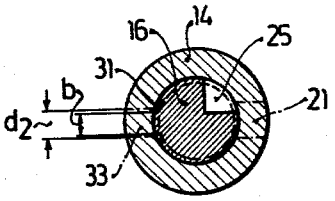
FIG. 3 is a cross-sectional view through the pump piston and pump cylinder along the line III—III in FIG. 1.
Figure 4:
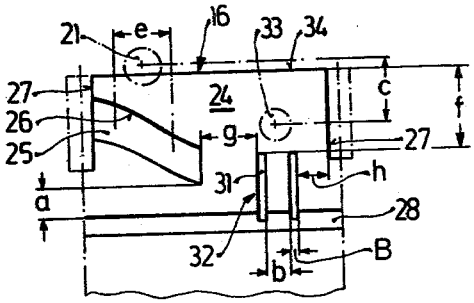
FIG. 4 is a development of the outer surface of the pump piston of the fuel injection pump shown in the FIGS. 1 through 3.
Figure 9:
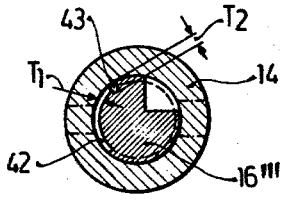
FIG. 9 is a cross sectional view through the pump piston and pump cylinder along the line IX—IX in FIG. 7.
Figure 10:
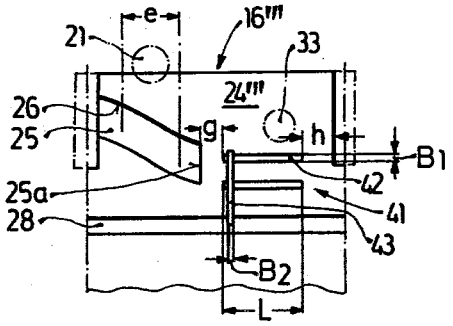
FIG. 10 is a development of the pump piston of the fourth embodiment shown in the FIGS. 7 through 9.

Further, as can be seen in the FIGS. 3 and 9, the bottom of the leakage oil return grooves is rounded, in order to decrease the notch effect caused by these grooves.

In one practical embodiment, a leakage oil channel arrangement corresponding to the fourth embodiment of the FIGS. 7 through 10 was produced in such a manner that for peak pressure around 600 bar with a pump piston diameter of 10 mm, the width and depth of the grooves 42 and 43 forming the leakage oil channel 41 were selected in the range of 0.5 mm. The leakage oil bore 33 and the control bore 21 each had a diameter of 3.5 mm.

With regard to the method of operation of the leakage oil channel means according to the invention, it remains to be stated that from the point when delivery begins, that is, after the closing of the control bore 21 by the upper edge of the pump piston formed by the frontal end surface 34 and the outer surface 24, until the end of delivery, at least one of the leakage oil return grooves 31, 31' or 36, 42 is in communication with the leakage oil bore 33, which leads to the suction chamber 22. In this manner no pressure higher than the suction chamber pressure can build up in the leakage oil channel means 32, 32', 32'', 41. By means of the improved embodiment of the leakage oil channels according to the invention, the supporting portion of the piston surface is improved as compared to known leakage oil channels, and there is a concomitant improvement of the lubricating effect and avoidance of a pressure build-up in the leakage oil channels.

This leakage oil channel means is always advantageous when the pump cylinder has to be produced with relatively thin walls yet operate at high injection pressures. Furthermore, the arrangement of the leakage oil return grooves on the surface of the pump piston is simpler to manipulate and handle than the arrangement of so-called scratch grooves and leakage oil collecting grooves in the wall of the cylinder bore.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An edge controlled fuel injection pump, having at least one pump piston forming, with a pump cylinder wall bore, an operating chamber, said piston being driven with a constant stroke and is both axially and rotationally movable within the cylinder bore and provided with an edge control recess in one side of its outer surface in constant communication with the operating chamber and which produces a connection between the operating chamber and a chamber with a lower pressure to end the fuel delivery by opening into a control bore in the pump cylinder wall and which has an annular leakage oil collecting groove separated from this recess, which groove during the piston stroke, can be connected with the low pressure chamber by means of a leakage oil channel and by means of a leakage oil bore in the cylinder wall opposite the control bore, said leakage oil bore opening into said pump cylinder bore and located an axial distance (c) from said control bore, said channel being formed in the outer surface of the piston, diametrically opposite the recess and extending in the direction of the operating chamber, and wherein the leakage oil channel comprises a plurality of leakage oil return grooves, one of which is in communication with the leakage oil collecting groove, said leakage oil return grooves being positioned on the outer surface of the piston and at a distance (b) from each other such that there is always at least one of the leakage oil return grooves in communication with the leakage oil bore during the useful stroke and in the rotational range (e) of the pump piston, which stroke and range determine the fuel injection quantity between idling and full load.

2. The injection pump according to claim 1, wherein the width of each of the leakage oil return grooves is at least 0.4 times the diameter (d) of the control bore.

3. The injection pump according to claim 2, wherein the extreme end of one leakage oil return groove is located next to the operating chamber at least a distance (f) from the piston surface facing the operating chamber to assure a high pressure seal.

4. The injection pump according to claim 3, wherein the cross section of each of the leakage oil return grooves is very narrow in comparison to the edge control recess, preferably so narrow that each groove is barely sufficient to carry the leakage fuel to the leakage fuel to the leakage oil bore.

5. The injection pump according to claim 4, wherein the leakage oil return grooves are disposed within the outer surface of the pump piston.

6. The injection pump according to claim 4, wherein at least two leakage oil return grooves are parallel to the leakage oil collecting groove.

7. The injection pump according to claim 4, wherein said recess has an edge located at an angle to the longitudinal axis of the pump piston and wherein the leakage oil return grooves are formed as angled spiral grooves, whose angle of inclination ($\alpha$) is the same as that of the control edge.

8. The injection pump according to claim 4, wherein at least two longitudinal grooves are parallel to each other and parallel to the longitudinal axis of the pump piston.

9. The injection pump according to claim 4, wherein at least two cross grooves located transverse to the longitudinal axis of the pump piston are preferably parallel to each other and having at least one connecting groove connecting the cross grooves with each other and with the leakage oil collecting groove.

10. The injection pump according to claim 9, wherein the connecting groove is inclined relative the longitudinal axis of the pump piston.

11. The injection pump according to claim 9, wherein the smallest value of the length (L) of the cross grooves is determined by the rotational range (e) of the pump piston and the largest value of this length is limited by a minimum distance (g and h) from the recess and from a stop groove that determines the zero delivery point, said minimum distance being provided to assure a high pressure seal.

12. The injection pump according to claim 9, wherein the connecting groove is parallel to the longitudinal axis of the pump piston.

13. The injection pump according to claim 12, wherein the width ($B_2$) of the longitudinal groove is smaller than the depth ($T_2$) and the width ($B_1$) of the cross grooves is larger than their depth ($T_1$).

14. The injection pump according to claim 12, wherein the cross grooves are preferrably equally long and arranged to open on one end into the longitudinal groove.

15. The injection pump according to claim 14, wherein the leakage oil bore is connected to only one of the cross grooves during the useful stroke and in the rotational range (e) of the pump piston which range determines the fuel injection quantity between idling and full load.

16. The injection pump according to claim 14, wherein the longitudinal groove is located next to the end of the recess that controls the greatest fuel injection quantity.

* * * * *